United States Patent [19]

O'Mullan et al.

[11] 4,233,765

[45] Nov. 18, 1980

[54] FRAME FOR SECURING FLEXIBLE SHEETS OF MATERIAL

[76] Inventors: Norman P. O'Mullan, 412 Essex Ave., Bloomfield, N.J. 07003; Paul R. T. Hahn, 515 Sherwood Pkwy., Westfield, N.J. 07090

[21] Appl. No.: 962,989

[22] Filed: Nov. 22, 1978

[51] Int. Cl.[3] ..... G09F 1/12

[52] U.S. Cl. ..... 40/156; 40/603; 160/378

[58] Field of Search ..... 40/156, 152.1, 152, 40/158, 155, 154, 153, 603, 124.2; 160/373, 378, 380

[56] References Cited

U.S. PATENT DOCUMENTS

| | | | |
|---|---|---|---|
| 2,601,734 | 7/1952 | Couzinet | 40/156 X |
| 3,591,940 | 7/1971 | Slemmons | 40/603 |
| 3,594,939 | 7/1971 | Parker | 40/156 |
| 4,055,909 | 11/1977 | Perry | 40/124.2 |

FOREIGN PATENT DOCUMENTS

| | | | |
|---|---|---|---|
| 1352750 | 1/1964 | France | 40/152 |
| 101928 | 3/1963 | Norway | 40/154 |

*Primary Examiner*—John F. Pitrelli

*Attorney, Agent, or Firm*—Weingram & Klauber

[57] ABSTRACT

A peripheral frame member holds flexible sheets of material tightly over a central open area. A channel around the back of the frame is adapted to receive a flexible strip member having a longitudinally extending bifurcated projection engageable within the length of the channel. When a thin sheet of flexible material is placed over the back of the frame and the strip member pressed down so that the projection fits tightly within the channel, the material is locked in place and stretched taut across the central open area. The frame is preferably rectangular with channels along each side and a plurality of longitudinal strips engage respective sides. The device provides a simplified structure which is particularly useful for holding and displaying fabrics for embroidery and needlecraft projects.

9 Claims, 7 Drawing Figures

FRAME FOR SECURING FLEXIBLE SHEETS OF MATERIAL

BACKGROUND OF THE INVENTION

1. Field of the Invention

The present invention relates to devices for holding flexible sheets of material within a frame and particularly to a simplified frame structure which secures the material tightly across a central open area.

2. Statement of Prior Art

A previous application Ser. No. 804,062 for Interlocking Frame, filed June 6, 1977, by Norman P. O'-Mullan, now abandoned, described a similar rectangular frame having an indentation along the back surface of each leg and a plurality of longitudinal strips with protrusions which engaged respective indentations to hold flexible sheets of material within the frame. The protrusion on each strip, however, was a single ridge which was relatively inflexible and did not provide sufficient locking and tightness of the material within the indentation and across the frame. Another known related prior art device is found in U.S. Pat. No. 3,594,939, issued July 27, 1971, which shows a solid rectangular picture frame having grooves around the front edges and flat longitudinal inserts which fit into the grooves over a flexible material to secure the material across the face of the frame. U.S. Pat. No. 3,757,479, issued Sept. 11, 1973, shows a flexible strip having an inverted V-shape which is pressed into an oppositely formed wide V-shaped groove around the sides of a frame to hold a flexible mirror material. A further structure is found in U.S. Pat. No. 3,987,835 issued Oct. 26, 1976, which utilizes a flexible beaded insert which engages a similarly shaped wide channel to hold a cover sheet in a rigid structure. The various other prior art structures are also either not sufficiently flexible, are difficult to assemble, or do not hold the material in a desired smooth tight secure manner across a frame.

SUMMARY OF THE INVENTION

It is therefore the primary object of the present invention to provide an improved simplified readily assembled frame structure for holding flexible sheets of material in a secure tight manner.

This is achieved with a peripheral frame structure having a channel around the back surface. A longitudinal strip, or plurality of strips, includes a flexible bifurcated projection which slideably engages the channel when no material is present. When a thin sheet of flexible material is placed over the back of the frame, the strips are pressed into the channel so that the flexible projection tightly engages the material within the channel and the material is pulled tightly and smoothly across the central opening of the frame. The projection is preferably of a V-shaped cross-section section and may have small sharp ridges along the outer sides of the legs of the V to more securely grip and lock the material in place. The frame is preferably rectangular with a plurality of connecting channels along each side. The channels may also have angled walls to fit the legs of the projection. Other objects and advantages will become apparent from the following description in conjunction with the accompanying drawings.

DESCRIPTION OF THE PREFERRED EMBODIMENTS

Figure 1:
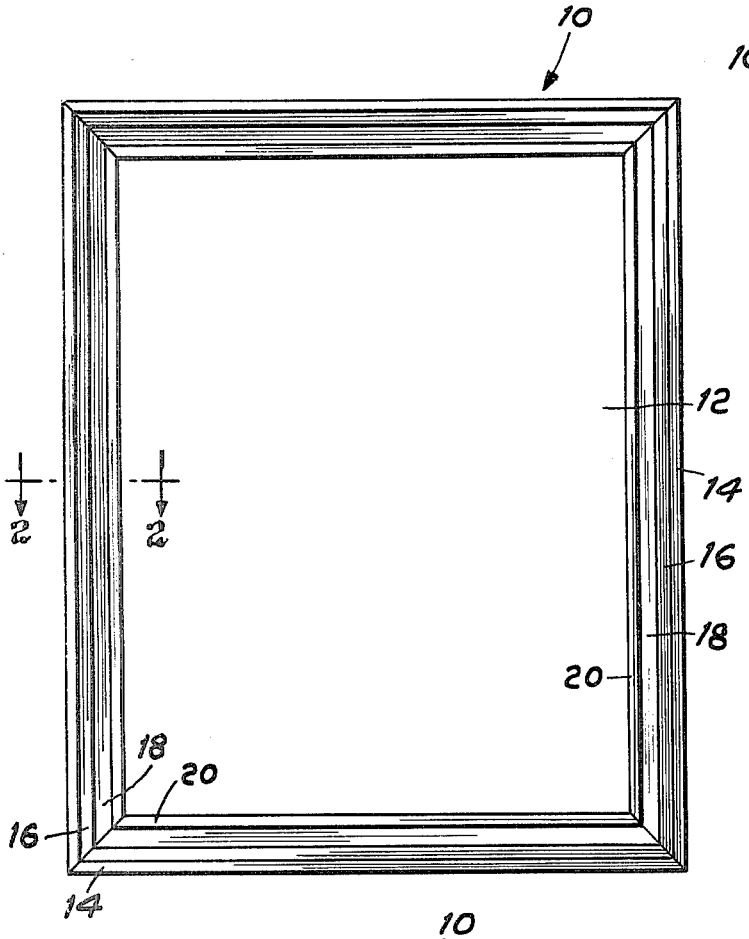
FIG. 1 is a plan view of the back of a frame structure in accordance with the present invention.
Figure 2:
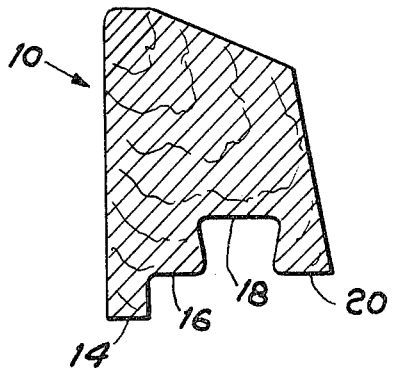
FIG. 2 is a cross-sectional view of the frame structure taken at section 2—2 of FIG. 1.

As shown in FIGS. 1 and 2, a rectangular frame 10, which may be of any suitable material, such as wood or plastic, is used to hold and display thin flexible sheets of fabric, or like materials, for embroidery and needlecraft projects. The flexible sheet of material is generally stretched tightly across the central open area 12 and must be firmly and continuously retained in the taut position. The back of the frame includes an outer border 14 extending rearwardly along the perimeter around the four sides and an inner recessed flat ledge 16 extending parallel to the border. A channel 18 is formed in ledge 16 and also extends around the four sides of the frame, while the innermost portion of ledge 16 forms the inner wall 20 of the frame around the open area 12. The side walls of the channel may be angled inwardly, as indicated, to provide a restricted opening.

Figure 3:
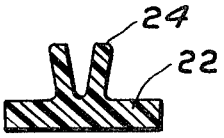
FIG. 3 is a cross-sectional end view of the V-shaped projection and longitudinal strip which engages the frame structure.
Figure 4:
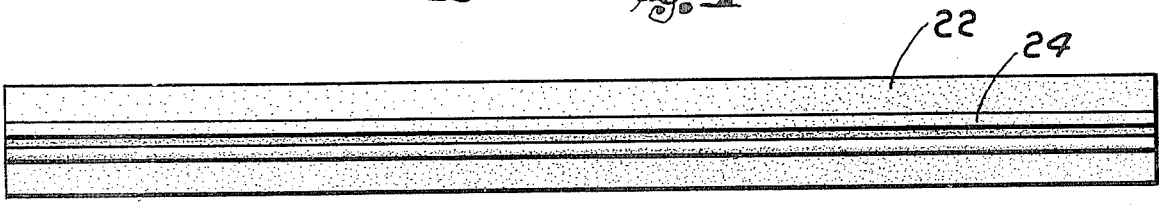
FIG. 4 is a plan view of a V-shaped strip.

As shown in FIGS. 3 and 4, a flat longitudinal strip 22 of a suitable flexible plastic material, such as polypropylene, includes a bifurcated V-shaped projection 24 extending along the base of the strip. The outer widest dimension of the V-shaped projection is designed to fit readily into the opening of channel 18 in a sliding engagement when there is no intermediate material. The legs of the projection are angled to fit the angled side walls of channel 18. The flat faces of the strip 22 on the opposite sides of projection 24 also rest against the flat ledge 16 adjacent channel 18. Four such strips are preferably used to engage the length of channel 18 along each of the four sides of the frame.

Figure 7:
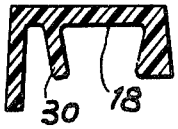
FIG. 7 is a cross-sectional view of another form of frame structure.
Figure 5:
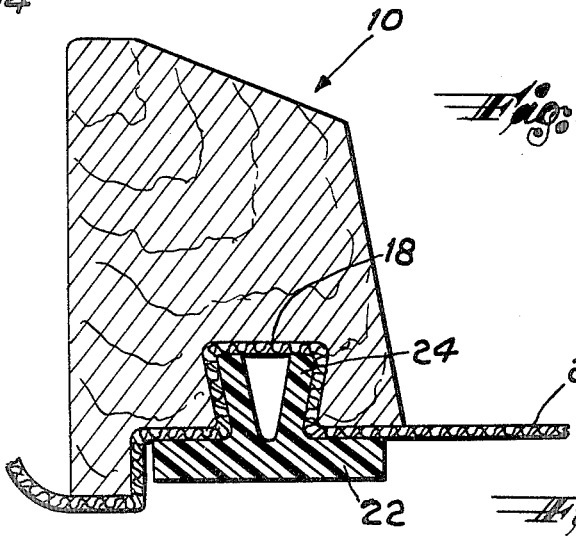
FIG. 5 is a cross-sectional view showing the V-shaped strip engaging the frame and material.
Figure 6:
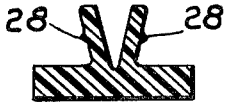
FIG. 6 is a cross-sectional end view of another form of V-shaped strip.

When a thin flexible sheet of material 26, or fabric to be worked on, is stretched over the back of the frame, as in FIG. 5, the flexible strips 22 are respectively positioned over the channel 18 in each side. The V-shaped projection is now wider than the width of the channel opening including the thickness of material 26, so that the projection must now be forcibly pressed into the channel over the material. Since the bifurcated sections of the V are flexible, the two legs force the material in and are pressed together as they engage the channel and material and then open sightly within the channel to provide a continuous outward pressure against the sides of the channel while stretching and clamping the material in an extremely tight manner. As each strip is inserted into the channel along each side of the frame, the material is stretched tightly and smoothly across the open area of the frame and thus locked in position. As shown in FIG. 6, each leg of the projection may include a small pointed ridge 28 on the outer side to provide an additional gripping penetrating action which further prevents movement of the material out of the channel. This is particularly useful in conjunction with a channel having straight walls instead of angled walls. FIG. 7 shows a variation of frame member 10 which may be made of a flexible plastic material such as polypropylene. In this case a flexible side wall 30 forms the angled outer wall of channel 18 to facilitate insertion and removal of bifurcated projection 24 of strip 22.

Typical dimensions of the various elements may be about $\frac{3}{4}$ inch for the width of a side of the frame, including $\frac{1}{8}$ inch for border 14, 174 inch for the opening of channel 18, 3/16 inch for the depth of the channel, and an angle of 9° for the channel walls. The frame may be about 1 inch deep and the sides may be of any length and width suitable for holding and displaying sheets of fabric used for needlecraft. The base of strip 22 may be about 5/16 inch wide and $\frac{1}{8}$ inch thick, while V-shaped legs 24 may be 3/16 inch long, $\frac{1}{4}$ inch wide at the maximum outer dimension, $\frac{1}{8}$ inch at the innner dimension across the open end, and 1/16 inch thick. The angle of the legs may be 12° from the vertical. The strips may be several inches long to accomodate the size of the frame. The channels, strips and legs may also be of various other suitable sizes, shapes and materials. The channel sizes, for example, may accomodate fabrics and sheets of various thicknesses, such as silk, canvas, paper, wool, polyesters, etc. Thus, wider, deeper channels would receive thicker coarser materials, while smaller narrow channels would be used with finer, thinner materials. The strips may also be of other materials such as rubber or thin flexible metals. Frames could also be made of stiff cardboard. Where a frame is made of hard wood, a straight walled channel may be preferable, while angled walls may be made more readily in softer woods. At least one of the engaging members should be of a relatively flexible material, such as a rigid wooden frame with a flexible plastic strip and projection. Where the frame is of a flexible plastic, the strip member may be of a more rigid material.

The easily assembled frame with material and locking strips has the inherent advantages of maintaining fabric in a tightly stretched aligned position without movement or damage to the material while being worked on, does not require additional blocking equipment, and can be used as a permanent display for completed projects or various other objects.

While only a limited number of embodiments have been illustrated and described, many other variations may be made in the particular design and configuration without departing from the scope of the invention as set forth in the appended claims.

What is claimed is:

1. A frame for securing thin flexible sheets of material comprising:

a support member having a channel in one face, said channel being adapted to receive a thin flexible sheet of material, and a longitudinal flexible locking member having a thin flat base and a pair of thin angled legs extending outwardly along a central area of said base, the widest dimension across the open ends of said legs being normally engageable with the opening of said channel in a sliding fit, said legs being compressible to reduce said dimension and engage said channel in a press fit when said thin fexible sheet of material is disposed intermediate said support member channel and said locking member to secure said sheet within said channel said support member and channel extend about the periphery of a central open area, said locking member being a flexible strip including said legs extending along said strip and flat surfaces along said base adjacent said legs said flat surfaces being engageable with said support member adjacent said channel, said support member includes a front face and a back face, said channel extending around and into the back face, and a plurality of flexible strips engageable with said channel in said support member to hold said sheet of material tightly across said open area.

2. The frame device of claim 1 wherein said widest dimension of said legs is substantially equal to the width of the channel opening.

3. The frame device of claim 1 wherein said legs are v-shaped, the open ends of said legs being compressible during engagement with said channel in said press fit.

4. The frame device of claim 3 wherein said V-shaped legs include pointed ridges on the outside walls.

5. The frame device of claim 3 wherein said support member includes an outer border extending rearwardly from said back face.

6. The frame device of claim 3 wherein said support member is of wood and said flexible strip is of plastic.

7. The frame device of claim 3 wherein said channel includes inwardly angled walls engageable with said V-shaped legs of said flexible strips.

8. The frame device of claim 7 wherein said support member is of a flexible material.

9. The frame device of claim 8 wherein said channel includes a thick inner side wall and a thinner more flexible outer side wall.

* * * * *